US007935668B2

(12) United States Patent
Enkel et al.

(10) Patent No.: US 7,935,668 B2
(45) Date of Patent: May 3, 2011

(54) PARTICULATE

(75) Inventors: Thomas Enkel, Ellerstadt (DE); Mladen Nedic, Waldsee (DE); Judith Preuschen, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 11/571,176

(22) PCT Filed: Jul. 4, 2005

(86) PCT No.: PCT/GB2005/002618

§ 371 (c)(1), (2), (4) Date: Sep. 5, 2007

(87) PCT Pub. No.: WO2006/003434

PCT Pub. Date: Jan. 12, 2006

(65) Prior Publication Data

US 2008/0113894 A1 May 15, 2008

(30) Foreign Application Priority Data

Jul. 2, 2004 (GB) ..... 0414826.8

(51) Int. Cl.
*C11D 17/00* (2006.01)

(52) U.S. Cl. ..... 510/488; 510/441; 510/229; 510/223; 510/303; 510/304; 510/375

(58) Field of Classification Search ..... 510/229, 510/223, 303, 304, 375, 488, 441
See application file for complete search history.

(56) References Cited

U.S. PATENT DOCUMENTS

| | | | | |
|---|---|---|---|---|
| 2,413,491 | A | 12/1946 | Fajans | |
| 4,650,909 | A * | 3/1987 | Yoakum | 568/621 |
| 5,367,740 | A | 11/1994 | McCray | |
| 5,719,111 | A | 2/1998 | van den Brom et al. | |
| 5,756,447 | A * | 5/1998 | Hall | 510/475 |
| 6,031,969 | A | 2/2000 | Burr | |
| 6,162,259 | A * | 12/2000 | Williams (nee Mac Beath) | 8/137 |
| 6,167,587 | B1 | 1/2001 | Bissell | |
| 6,679,642 | B1 | 1/2004 | Dillingham et al. | |
| 2002/0186996 | A1 | 12/2002 | Miller | |
| 2003/0081984 | A1 | 5/2003 | Larsen | |
| 2003/0198503 | A1 | 10/2003 | Gordon | |
| 2007/0015674 | A1 * | 1/2007 | Song et al. | 510/220 |

FOREIGN PATENT DOCUMENTS

| | | | |
|---|---|---|---|
| DE | 19937345 | A1 | 2/2001 |
| EP | 0881280 | A1 | 12/1998 |
| EP | 0882786 | A1 | 12/1998 |
| EP | 0999264 | A1 | 5/2000 |
| GB | 2311536 | A | 10/1997 |
| WO | 03/082048 | A1 | 10/2003 |

OTHER PUBLICATIONS

Combined Search and Examination Report from the Patent Office in Great Britain dated Dec. 3, 2004 for application GB0415516.4.
International Search Report dated Sep. 19, 2005 for application PCT/GB2005/002618.
Written Opinion of the International Searching Authority for application PCT/GB2005/002618.
English language abstract for DE 19937345 obtained online from the European Patent Office web site "esp@cenet".

* cited by examiner

*Primary Examiner* — Milton I. Cano
*Assistant Examiner* — M. Reza Asdjodi
(74) *Attorney, Agent, or Firm* — Norris McLaughlin & Marcus, PA

(57) ABSTRACT

A detergent composition comprises an MGDA containing particulate material. The MGDA particulate is at least partially coated with a coating of a water soluble/dispersible material having a melting point of less than 100° C. The coating material exhibits a pH of greater than or equal to 7 in an aqueous medium.

22 Claims, No Drawings

PARTICULATE

This is an application filed under 35 USC 371 of PCT/GB2005/002618.

The invention concerns a particulate comprising methyl glycine diacetic acid and a coating with a coating material which exhibits a pH of greater than or equal to 7 in an aqueous medium.

Household detergents are used widely in many applications including laundry care and for hard-surface cleaning such as in an automatic dishwasher. The detergents are commonly available in many product formats including liquids, powders and solids.

It is recognised that a common household detergent is usually made up of a number of different components. One component that is typically present in a laundry/automatic dishwasher detergent is a builder.

The builder is used as a chelating agent to aid the removal/capture of metal ions in solution. With their use deposits of metal ion based sediments (such as limescale) within automatic washing machines are reduced and the cleaning process is enhanced (certain stains incorporate a metal ion component, e.g. such as tea stains which comprise a calcium/tannin complex).

In the past and up until recently builders based upon phosphate have been used. These have the advantage of being inexpensive, compatible with other detergent components (both in solid and liquid detergent formulations) and washing machines, and widely available. However, one problem with the use of phosphate based builders is that of environmental pollution: excess phosphates in water courses are connected with detrimental environmental effects such as eutrification and excess algal growth, leading to other issues such as a reduction in fish populations.

Consequently the use of phosphates has been legislated against in certain jurisdictions and is being legislated against in further jurisdictions.

Thus there is a need for alternative builders/chelating agents.

One possible alternative is to use a salt of a polyfunctional carboxylic acid such as citrate. However, whilst salts such as citrate are more environmentally acceptable, the activity of citrate as a builder is not as high as that of phosphate. This is particularly noticeable at higher washing temperatures, such as those experienced in an automatic dishwasher (>50° C.).

Other builders based on aminocarboxylates have been considered, such as MGDA.

MGDA, whilst an extremely capable chelating agent has associated disadvantages connected with its inherent hygroscopicity. As a result MGDA is only commonly available in liquid form. If used in solid form as a powder MGDA leads to excessive caking of the powder formulation brought on by massive uptake of water. Similarly any other larger solid forms suffer from poor physical and chemical stability caused by water uptake.

Coating of MGDA particles has been attempted to address this issue. MGDA particles have been coated with a polycarboxylate (as described in DE-A-19937345) to prevent excessive water uptake. However, it has been found that whilst the use of this polymer has been able to address the hygroscopicity issue, the use of the polycarboxylate polymer, a polymer which is usually acidic in nature, reduced the pH of the MGDA containing formulation/wash liquors containing same to an unacceptable level for certain uses (e.g. such as automatic dishwashing). Additionally the further processing of the polycarboxylate coated MGDA particles has been hindered due to the high hardness of the polycarboxylate coating.

It is an object of the present invention to obviate/mitigate the problems outlined above.

According to a first aspect of the present invention there is provided a detergent composition comprising an MGDA containing particulate material wherein the particulate is at least partially coated with a coating of a water soluble/dispersible material having a melting point of less than 100° C., wherein the coating material exhibits a pH of greater than or equal to 7 in an aqueous medium.

It will be appreciated that the term MGDA is not limited solely to MGDA per se but also refers to compounds having formula (a):

$$MOOC—CHR—N(CH_2COOM)_2 \quad (a)$$

wherein R is H or $C_{1-12}$ alkyl.

M is H or an alkali metal (such as Li, Na, K, Rb); each M may be the same or different.

As the coating is non-acidic, the coating of the MGDA containing particulate does not limit the particulate from use in any particular detergent applications: the coated MGDA particulate can still be used in automatic dishwasher detergent formulations.

With the use of a coating the hygroscopicity problems associated with MGDA have been found to be addressed. Thus the MGDA can be incorporated into a detergent formulation for use as a builder without leading to the issues caused by water uptake. Thus detergent products made using these particulates have been found to exhibit excellent storage stability and, for powders, good pourability/flowability after prolonged storage.

Preferably the water soluble/dispersible coating material has a melting point of less than 80° C. (Generally the melting point is higher than room temperature to ensure the integrity of the coating). With such a melting point it has been found that the coated MGDA particulates can be readily processed into, for example, larger detergent bodies (e.g. such as tablets) without causing excessive abrasion to the processing equipment.

Generally the weight ratio of the water soluble/dispersible coating material to the MGDA is in the range of 3:1 (i.e. 75 wt % water soluble/dispersible coating material and 25 wt % MGDA) to 1:19 (i.e. 5 wt % water soluble/dispersible coating material and 95 wt % MGDA).

Suitable types of water soluble/dispersible coating material include water soluble/dispersible polymers and surfactants.

Where a surfactant is present it is preferred that the surfactant is nonionic. Preferred examples of nonionic surfactants include alkoxylated, (especially ethoxylated) alcohols with preferably 8 to 18 carbon atoms and on the average 1 to 12 mole ethylene oxide (EO) per mole of alcohol. Ethoxylated alcohols with linear alkyl chains, e.g. from alcohols of native origin with 12 to 18 carbon atoms, e.g. from cocoa, palm, tallow, or oleic oils, with on average 2 to 8 EO per mole alcohol are preferred. Thus the preferred ethoxylated alcohols include, for example, $C_{12-14}$ alcohols with 3 EO, 4 EO or 7 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohols with 3 EO and $C_{12-14}$ alcohols with 7 EO. It will be appreciated that the indicated ethoxylation degree represents statistic average values, which can be a whole or fractional number.

Fatty alcohols with more than 12 EO may be used as a nonionic surfactant. Examples include tallow fat alcohols with 14 EO, 25 EO, 30 EO or 40 EO.

Nonionic surfactant compounds, which contain ethylene oxide (EO) and propylene oxide (PO) groups are suitable for use in the present invention. Block copolymers with EO/PO blocks, EO-PO copolymers and mixed EO and PO copolymers may be used.

Also suitable are alkyl glycosides of the general formula $RO(G)_x$, in which R is a primary or methyl-branched alkyl chain, with preferably 8 to 22 and more preferably 12 to 18 carbon atoms and where G is a carbohydrate with 5 or 6 carbon atoms, preferably glucose. The oligomerisation degree x, which indicates the distribution of mono glycosides and oligo glycosides, is preferably between 1 and 10 and most preferably between 1.2 to 1.4.

A further group of preferred nonionic surfactants are alkoxylated (preferably ethoxylated) fatty acid alkyl esters, particularly with 1 to 4 carbon atoms in the alkyl chain, especially fatty acid methyl esters.

Also amine oxides, for example N-tallow-N, N-dihydroxyethylaminoxide, and the fatty acid alkonalamide equivalents thereof can be suitable.

Further suitable nonionic surfactants are polyhydroxy fatty acid amides of the formula (I):

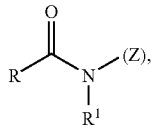

(I)

in which RC═O is an aliphatic acyl radical with 6 to 22 carbon atoms, $R^1$ is hydrogen, an alkyl or hydroxyalkyl group with 1 to 4 carbon atoms and (Z) is a linear or branched polyhydroxy alkyl chain with 3 to 10 carbon atoms and 3 to 10 hydroxyl groups.

Compounds of the formula (II) also belong to the group of the polyhydroxy fatty acid amides.

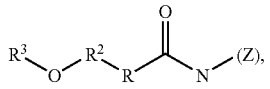

(II)

in which R is a linear or branched alkyl/alkenyl group with 7 to 12 carbon atoms, $R^2$ is a linear, branched or cyclic alkyl residue or an aryl residue with 2 to 8 carbon atoms and $R^3$ is a linear, branched or cyclic alkyl group or an aryl group or an oxy-alkyl residue with 1 to 8 carbon atoms, with $C_{1-4}$ alkyl or phenyl groups being preferred and (Z) is a linear polyhydroxyalkyl group, the alkyl chain of which is substituted with at least two hydroxyl groups, or alternatively alkoxylated, preferably ethoxylated or propxoylated.

A preferred example of a suitable nonionic surfactant which meet the melting point parameters above is an ethoxylated mono-hydroxy-alkanol or alkyl phenol with 6 to 20 carbon atoms with preferably at least 12 mole, particularly preferentially at least 15 mole, in particular at least 20 mole, ethylene oxide per mole alcohol/alkyl phenol. A particularly preferred non-ionic surfactant is a straight-chain fatty alcohol with 16 to 20 carbon atoms with at least 12 mole, preferably at least 15 mole and in particular at least 20 mole, ethylene oxide per mole alcohol.

Preferred examples of propoxylated nonionic surfactants include mono-hydroxy-alkanols/alkyl phenols with polyoxyethylene-polyoxypropylene block copolymer units. The alcohol and/or alkyl phenol part of such nonionic surfactants preferably comprises more than 30 wt %, particularly more than 50 wt % and most preferably more than 70 wt % of the molecular mass of the molecule.

A further preferred nonionic surfactant is of the formula (III):

$$R^4O[CH_2CH(CH_3)O]_x[CH_2CH_2O]_y[CH_2CH(OH)R^5 \quad \text{(III)},$$

in which $R^4$ is a linear or branched aliphatic hydrocarbon group with 4 to 18 carbon atoms or mixtures thereof, $R^5$ is a linear or branched hydrocarbon group with 2 to 26 carbon atoms or mixtures thereof, x has a value of from 0.5 to 1.5 and y has a value of at least 15.

A yet further preferred non-ionic surfactant is of the formula (IV):

$$R^6O[CH_2CH(R^8)O]_z[CH_2]_kCH(OH)[CH_2]_jOR^7 \quad \text{(IV)},$$

in which $R^6$ and $R^7$ are linear/branched, saturated/unsaturated, aliphatic or aromatic hydrocarbon groups with 1 to 30 carbon atoms, $R^8$ is hydrogen or methyl, ethyl, n-propyl, i-propyl, n-butyl, 2-butyl or 2-methyl-2-butyl, z is from 1 to 30, k and j are from 1 to 12, preferably from 1 to 5.

If $z \geqq 2$, each $R^8$ may be the same or different. For example, if z is 3, $R^8$ may be selected, in order to form ethylene oxide ($R^8$═H) or propylene oxide ($R^8$═$CH_3$) units, which can be adjacent in varying order, for example (EO)(PO)(EO), (EO)(EO)(PO), (EO)(EO)(EO), (PO)(EO)(PO), (PO)(PO)(EO) and (PO)(PO)(PO). $R^8$ is most particularly preferential hydrogen, methyl or ethyl. Most preferred values for z lie within the range of 1 to 20, e.g. from 6 to 15. $R^6$ and $R^7$ preferably have 6 to 22 carbon atoms, with 8 to 18 carbon atoms being particularly preferred.

It is preferred that k=1 and j=1, so that formula (IV) becomes formula (V):

$$R^6O[CH_2CH(R^8)]_zCH_2CH(OH)CH_2OR^7 \quad \text{(V)}.$$

$R^6$, $R^7$ and $R^8$ are as in Formula (IV) and z is from 1 to 30, particularly from 1 to 20 and most particularly from 6 to 18. Especially preferred are surfactants where $R^6$ and $R^7$ have up to 14 carbon atoms, $R^8$ is hydrogen and z is from 6 to 15.

Most preferred examples of surfactants include those surfactants based on a $C_{16-18}$ fatty alcohol with an average ethoxylation degree of 25 (e.g. such as Lutensol AT25 (BASF) and Volpo CS25—(Croda)). Preferred examples of polymers include polyvinyl alcohol derivatives, polyvinylpyrolidone (PVP), polyalkylene glycol and derivatives thereof.

As these compounds are commonly used as binding agents for detergent bodies, such as tablets, these compounds can also be used to provide this secondary function (plus the surfactant function for the surfactant coating materials) as well as ensuring the low water uptake of the MGDA.

Furthermore these compounds have been found to be advantageous as processing aids in the formation of detergent bodies, e.g. in; injection moulding processes, extrusion processes, melt/pour or melt/press processes.

Most preferably the coating material is polyethylene glycol having a molecular weight of 500 to 30000, more preferably 1000 to 5000 and most preferably 1200 to 2000. Preferred examples of polyethylene glycol include 1500 and 20000.

The MGDA particulate may further incorporate auxiliary materials, like usual detergent additives or fillers The particulate is preferably formed in a process comprising mixing an MGDA solution with a solution of the coating material followed by drying this solution. Alternatively the MGDA and the coating material may be mixed together before being solvated. Preferred examples of solvents include water, alcohol (e.g. ethanol), and admixtures thereof. A preferred drying process involves spray drying of MGDA solution with the coating material.

The detergent composition may comprise a powder, a non-aqueous gel, a compressed particulate body, an injection moulded body or an extruded body. The composition may further incorporate auxiliary materials, like usual detergent additives or fillers, e.g. one or more of the following agents; bleach, corrosion inhibition agent, fragrance, co-builder, surfactant, binding agent, dye, acidity modifying agent, dispersion aid, enzyme, or preservative.

The composition is preferably for use in an automatic washing process e.g. such as in a automatic dishwasher/automatic clothes washer. Thus according to a second aspect of the present invention there is provided the use of a detergent composition comprising a MGDA containing particulate material wherein the particulate is at least partially coated with a coating of a water soluble/dispersible material, wherein the coating material exhibits a pH of greater than or equal to 7 in an aqueous medium, in an automatic dishwashing process or laundry process.

The invention is now further described with reference to the following non-limiting Examples.

EXAMPLE 1

Moisture Uptake Measurement

MGDA particulate having a partial coating of PEG 1500 (prepared by mixing) were prepared according to the table below. These particulates were added to a powder detergent formulation such that the particulates comprised 50 wt % of the formulation.

The formulations were weighed and then stored under controlled conditions (see Table) and then re-weighed. The weight increase was then assessed. The results are shown in the Table below.

| Formulation | Weight Increase (%) after 24 h at 45° C./75% RH | Weight Increase (%) after 1 week at 25° C./50% RH |
|---|---|---|
| MGDA dried | 80 | 7.0 |
| MGDA:PEG 1500 Coating (50:50) | 52 | 0.2 |
| MGDA:PEG 1500 Coating (66:33) | 59 | 2.7 |
| MGDA:PEG 1500 Coating (75:25) | 60 | 2.7 |
| MGDA:PEG 1500 Coating (80:20) | 68 | 2.7 |

All of the MGDA particulates exhibit extremely low hygroscopicity.

EXAMPLE 2 pH Measurement

The pH of the MGDA particulates in 1 wt % aqueous solution of Example 1 was measured with a conventional pH-Meter.

In each case the pH was found to be above 10. The pH of these formulations is suitable for incorporation into an automatic washing detergents, such as an automatic dishwashing detergent.

This compares favourable to MGDA particulates which are coated with a polycarboxylate such as Sokolan PA 30 which exhibit much lower pH (pH lower than 10) and for 50% coating a pH of lower than 8.

The invention claimed is:

1. A detergent composition comprising an MGDA containing particulate material, said material consisting essentially of MGDA at least partially coated with a coating of a water soluble and/or dispersible material having a melting point of less than 100° C., wherein the coating material exhibits a pH of greater than or equal to 7 in an aqueous medium, wherein an amount of the MGDA is greater than an amount of the water soluble and/or dispersible coating material such that a weight ratio of the MGDA to the water soluble and/or dispersible coating material is a ratio greater than 1:1.

2. A composition according to claim 1, wherein the water soluble and/or dispersible coating material has a melting point of less than 80° C.

3. A composition according to claim 2 wherein the water soluble and/or dispersible coating material comprises a water soluble and/or dispersible polymer and/or a surfactant.

4. A composition according to claim 3, wherein the surfactant is based on a $C_{16-18}$ fatty alcohol with an average ethoxylation degree of 25.

5. A composition according to claim 3, wherein the polymer comprises a polyvinyl alcohol derivative, polyvinylpyrolidone (PVP), polyalkylene glycol and/or a derivative thereof.

6. A composition according to claim 1, wherein the water soluble and/or dispersible coating material comprises a water soluble and/or dispersible polymer and/or a surfactant.

7. A composition according to claim 6, wherein the surfactant is based on a $C_{16-18}$ fatty alcohol with an average ethoxylation degree of 25.

8. A composition according to claim 6, wherein the polymer comprises a polyvinyl alcohol derivative, polyvinylpyrolidone (PVP), polyalkylene glycol and/or a derivative thereof.

9. A composition according to claim 8, wherein the coating material is polyethylene glycol having a molecular weight of 1500 or 20000.

10. A composition according to claim 6, wherein the coating material is polyethylene glycol having a molecular weight of 1500 or 20000.

11. A composition according to claim 1, wherein the particulate incorporates an auxiliary material.

12. A composition according to claim 1, wherein the composition comprise a powder, a non-aqueous gel, a compressed particulate body, an injection moulded body or an extruded body.

13. An automatic dishwashing process which comprises the step of: utilizing a composition according to claim 1.

14. A laundry process which comprises the step of utilizing a composition according to claim 1.

15. A detergent composition according to claim 1 wherein the weight ratio of the MGDA to the water soluble and/or dispersible coating material is in the range of between 19:1 to a ratio of greater than 1:1.

16. A detergent composition according to claim 15 wherein the weight ratio of the MGDA to the water soluble and/or dispersible coating material is in the range of between 4:1 to a ratio of greater than 1:1.

17. A detergent composition according to claim 15 wherein the weight ratio of the MGDA to the water soluble and/or dispersible coating material is in the range of between 3:1 to a ratio of greater than 1:1.

18. A detergent composition according to claim 17 wherein the weight ratio of the MGDA to the water soluble and/or dispersible coating material is in the range of between 2:1 to a ratio of greater than 1:1.

19. A detergent composition comprising an MGDA containing particulate material, said material consisting essentially of MGDA at least partially coated with a coating of a water soluble and/or dispersible material having a melting point of less than 100° C., wherein the coating material exhibits a pH of greater than or equal to 7 in an aqueous medium, wherein the concentration of the MGDA is greater than 50 wt % and not more than 95 wt %.

20. A composition according to claim 19 wherein the water soluble and/or dispersible coating material comprises a water soluble and/or dispersible polymer and/or a surfactant.

21. A composition according to claim 20, wherein the surfactant is based on a $C_{16-18}$ is fatty alcohol with an average ethoxylation degree of 25.

22. A composition according to claim 20, wherein the polymer comprises a polyvinyl alcohol derivative, polyvinylpyrolidone (PVP), polyalkylene glycol and/or a derivative thereof.

* * * * *